US005803536A

United States Patent [19]

Perzee et al.

[11] Patent Number: 5,803,536

[45] Date of Patent: Sep. 8, 1998

[54] COLLAPSIBLE AND PORTABLE PICNIC TABLE

[75] Inventors: Rodney B. Perzee, Chebanse; Henry O. Perzee, Beaverville, both of Ill.

[73] Assignee: Perzee, Inc., Chebanse, Ill.

[21] Appl. No.: 829,732

[22] Filed: Mar. 31, 1997

[51] Int. Cl.[6] ..... A47B 39/00

[52] U.S. Cl. ..... 297/158.5; 108/180

[58] Field of Search ..... 297/440.1, 440.22, 297/440.24, 135, 157.1, 158.3, 158.5, 172, 170, 158.4, 159.1; 108/159, 180, 181, 186, 187

[56] References Cited

U.S. PATENT DOCUMENTS

| | | | |
|---|---|---|---|
| 2,722,971 | 11/1955 | Gallagher et al. | 297/158.5 |
| 2,746,525 | 5/1956 | Cooper | 297/158.5 |
| 2,825,390 | 3/1958 | Post | 297/440.24 X |
| 4,330,151 | 5/1982 | Healey | 297/158.3 |
| 5,011,228 | 4/1991 | Marcantel | 297/158.5 X |
| 5,224,753 | 7/1993 | Fox | 297/158.5 |

*Primary Examiner*—Milton Nelson, Jr.
*Attorney, Agent, or Firm*—Hill & Simpson

[57] ABSTRACT

A collapsible table for outdoor use such as camping, picnicking or patio use is provided. The table is collapsible, portable strong and stable so that it is suitable for use as a dining table. The table includes seven separate parts including a table top with two brackets mounted to the underside of the table top, two bench seats, each with two brackets disposed on the underside of the bench seats, two E-shaped support frames and two E-shaped tie-down brackets. In the assembled position, the larger E-shaped support frames connect each bracket of the table top to respective brackets disposed on the undersides of the bench seats. In the collapsed or portable position, the tie-down brackets similarly connect the bench seats to the table top with the support frames trapped between the bench seats and the table top.

17 Claims, 9 Drawing Sheets

COLLAPSIBLE AND PORTABLE PICNIC TABLE

FIELD OF THE INVENTION

The present invention relates generally to furniture designed primarily for outdoor use such as for camping, patio furniture and related activities such as picnicking. More specifically, the present invention relates to a picnic table that is portable, easily assembled and easily disassembled.

BACKGROUND OF THE INVENTION

Camping and picnicking are extremely popular outdoor activities. Typically, campers and picnickers will bring portable furniture with them due to the complete lack of picnic tables at many popular destinations and further due to the lack of an adequate number of picnic tables at many established campgrounds and picnic areas. The typical design for such portable furniture includes chairs having a collapsible aluminum frame with seats and backs made from woven polymer fabrics that are both lightweight and strong. In terms of tables, the typical design includes an aluminum frame with a one or two piece table top that is also fabricated from aluminum or another suitable lightweight material.

However, these portable tables are not strong and do not provide a secure or steady foundation when employed as a picnic or an eating table. Specifically, the extremely lightweight nature of these tables makes them unsteady and, if knocked or bumped during use, the vibrations resulting from the knocking or bumping action will cause food to easily spill. As a result, the currently available portable picnic tables do not serve well as a dining table for more than one person or for a family.

Further, the currently available portable picnic tables typically do not include one or more seats incorporated into the table design. As a result, users must bring a plurality of collapsible chairs in addition to the portable picnic table in order for more than one person or a family to use the table as a picnic or dining table. The combination of the unsteady collapsible picnic tables with the detached or separate chairs often results in the table being bumped or knocked by the chairs or the people as they sit at the table which, more often than not, results in the spillage of food disposed on the table top surface.

Accordingly, there is a need for an improved portable picnic table that is collapsible and portable and further that provides a steady and secure foundation so that the table may be used as a dining table in the outdoors. Still further, there is a need for an improved portable picnic table that incorporates seats with the table structure.

SUMMARY OF THE INVENTION

The present invention satisfies the aforenoted needs by providing a collapsible and portable table comprising a table top, two bench seats and two support frames for detachably connecting the table top to the bench seats. Specifically, each support frame preferably has a E-shaped configuration with a middle leg and two opposing first and second legs. The middle legs are attached to brackets disposed on the underside of the table top. One opposing leg of each support frame engages a bracket disposed on an underside of one bench seat and the other opposing leg of the support frame engages a bracket disposed on an underside of the other bench seat. Hence, each support frame provides a rigid link between the two bench seats and the table top when the table is in the set-up position.

In a preferred embodiment, the brackets disposed on the undersides of the table top and the bench seats are disposed adjacent to the opposing ends of the table top and the bench seats. Hence, the support frames are disposed along opposing ends of both the table top and the bench seats. Still further, in a preferred embodiment, the brackets disposed under the table top and the bench seats comprise downwardly extending sleeves that receive the upper ends of the legs of the support frames. Specifically, the brackets disposed on the underside of the table top comprise downwardly extending sleeves, each of which receives an upper end of one middle leg of one support frame. Similarly, each bracket disposed on the undersides of the bench seats, at opposing ends thereof, also include downwardly extending sleeves, each of which receives one upper end of an opposing leg of one of the support frames.

In a preferred embodiment, each bracket further comprises a hole through which a shaft or pin which is threadably connected to the bracket extends. The shaft or pin is extended through the hole after the table has been placed into the set-up position to frictionally engage an upper end of the leg of the support frame to more securely attach the bench seats and the table top to the support frames.

In an embodiment, the upper ends of the legs of the support frame also include holes that are disposed in matching registry with the holes of the bracket so that the pins or shafts extend through the holes in the upper ends of the legs of the support frame.

In an embodiment, the support frames are E-shaped with the upper ends of the three legs engaging a bracket of a bench seat or a table top. The lower ends of the three legs are connected by a lower support that engages the ground when the table is in the set-up position and provides support for the entire table structure. The lower supports are further characterized as having a length. The table top is also characterized as having a length. The length of the lower supports of each support frame is less than the length of the table top so that when in the collapsed position, the support frames may lie flat against the underside of the table top without extending beyond the opposing ends of the table top.

In an embodiment, the bench seats are the same length as or slightly shorter than the length of the table top so that, when in the collapsed position, the bench seats may be stacked neatly underneath the table top on opposing sides of the brackets attached to the underside of the table top and with the support frames disposed between the bench seats and the underside of the table top.

In an embodiment, the table top of the present invention further comprises two tie-down brackets. Each tie-down bracket comprises a middle leg disposed between two opposing legs. When the bench seat and table top are in the collapsed position, i.e., the bench seats are disposed underneath the table top, on opposing sides of the brackets attached to the underside of the table top, and with the support frames laying neatly between the bench seats and the underside of the table top, the opposing legs of each tie-down bracket engage a bracket disposed on the underside of a bench seat and each middle leg of each tie-down bracket engages a bracket disposed on the underside of the table top in a manner similar to the engagement between the support frame and the respective brackets of the bench seats and the table top but in the collapsed position as opposed to the set-up position. With the tie-down bracket connecting the bench seats and the table top in the collapsed position, and with the support frames trapped between the top sides of the bench seats and the underside of the table top, the table is in a collapsed position and can be easily transported. Properly dimensioned, such a table top can easily fit into the back of a conventional automobile, such as a mini-van or the trunk of a larger sedan.

Accordingly, the present invention provides a collapsible, but sturdy and stable picnic table that may be fabricated from essentially seven parts. First, a table top is provided with two brackets disposed at opposing ends of the table top on an underside thereof. Similarly, two bench seats are also provided with two brackets disposed at opposing ends of the bench seat at an underside thereof. Two E-shaped support frames are also provided. In the set-up position, the middle legs of the support frames are matably received within the brackets disposed along the underside of the table top and the outer opposing legs (i.e., the first and second legs) of the support frame are matably received in a bracket of a bench seat. Thus, each E-shaped bracket connects one, end of the bench seat to one end of the table top and to one end of the other bench seat when the table is in the set-up position.

To collapse the table for transport, the bench seats and table tops are removed from the support frames. The table top is then laid upside-down and the support frames are placed on the underside of the table top along opposite sides of the table top so that the lower support structure of each support frame is disposed along a side edge of the table top and the legs are directed inward toward the center of the table top and toward the other support frame. In a preferred embodiment, an upper end of one of the middle legs of one of the support frames includes a hole and, a lower end of the middle leg of the other support frame includes a plate structure with a threaded pin attached thereto that may be matably received within the hole disposed at the upper end of the middle leg of the other support frame when the two support frames are disposed on the underside of the table top in the collapsed position. By connecting the two support frames in this way in the collapsed position, there is no chance that the support frames can become dislodged during transport and handling of the table in the collapsed position.

After the support frames are in place along the underside of the table top as described above, bench seats are placed on top of the support frame with the brackets of the table top disposed therebetween. When placed in this position, each bracket of the table top is in alignment with one bracket from each bench seat. An E-shaped tie-down bracket with a middle leg for a table top bracket and two opposing legs for the bench seat brackets is then inserted so that the bench seats are connected to the bracket of the table top in the collapsed position. The threaded pins attached to the brackets may then be passed through the holes disposed in the brackets to engage the tie-down bracket to secure the table top in the collapsed position.

It is therefore an object of the present invention to provide an improved collapsible and portable picnic table.

Yet another object of the present invention is to provide an improved collapsible and portable table for use as camping equipment.

Yet another object of the present invention is to provide an improved collapsible and portable table for use as patio furniture.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of an example of the present invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING THE PREFERRED EMBODIMENTS

Figure 1:
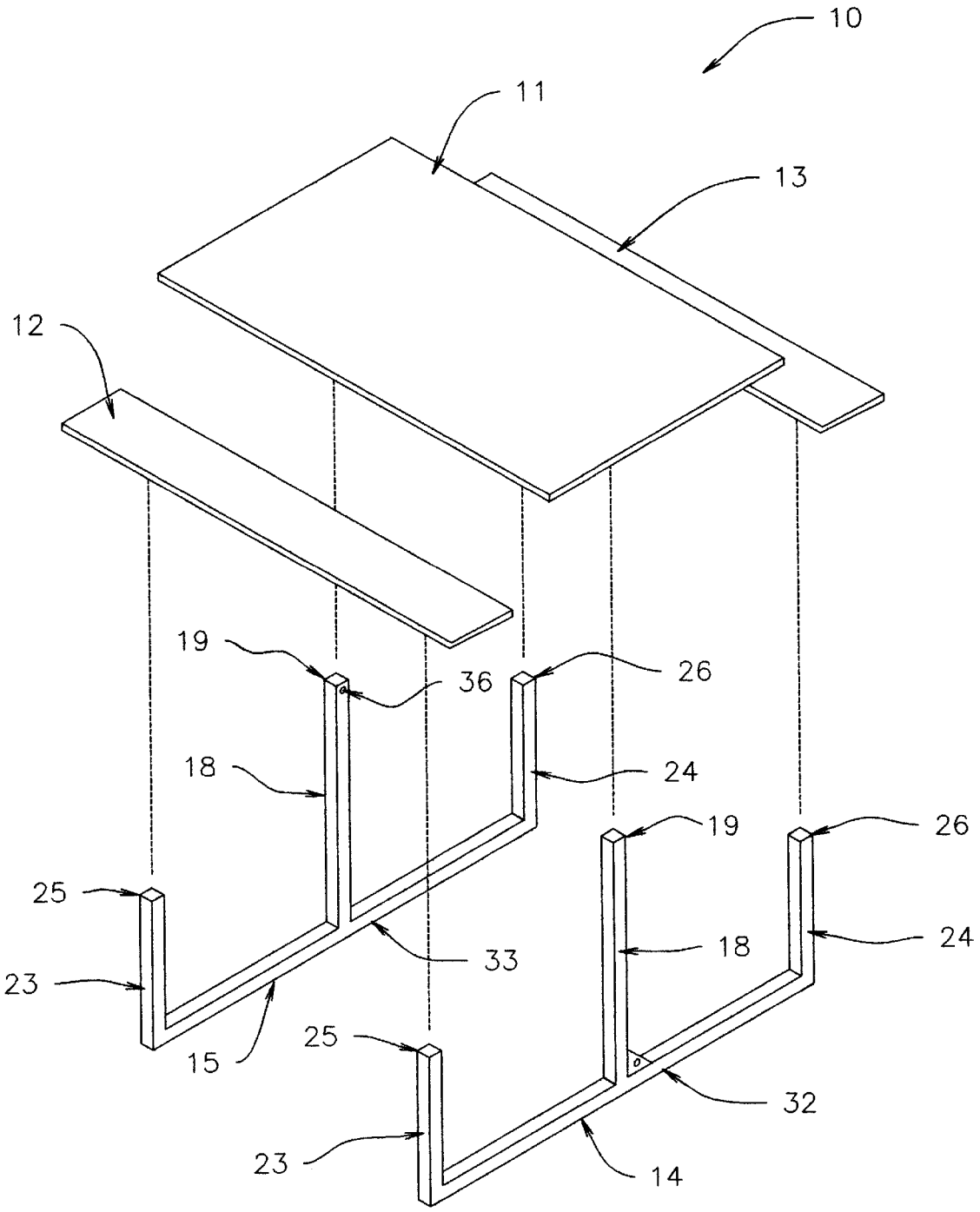
FIG. 1 is an exploded perspective view of a portable picnic table made in accordance with the present invention.

Turning first to FIG. 1, the table 10 of the present invention is shown in an exploded view of the set-up position. The table 10 includes a table top 11, bench seats 12, 13, support frames 14, 15 and tie-down brackets 16, 17 (not shown in FIG. 1, see FIGS. 7–10). Thus, the portable and collapsible table 10 includes seven separate parts, all of which are substantial in size and therefore the likelihood of a consumer losing one or more parts of the table 10 is remote.

Figure 2:
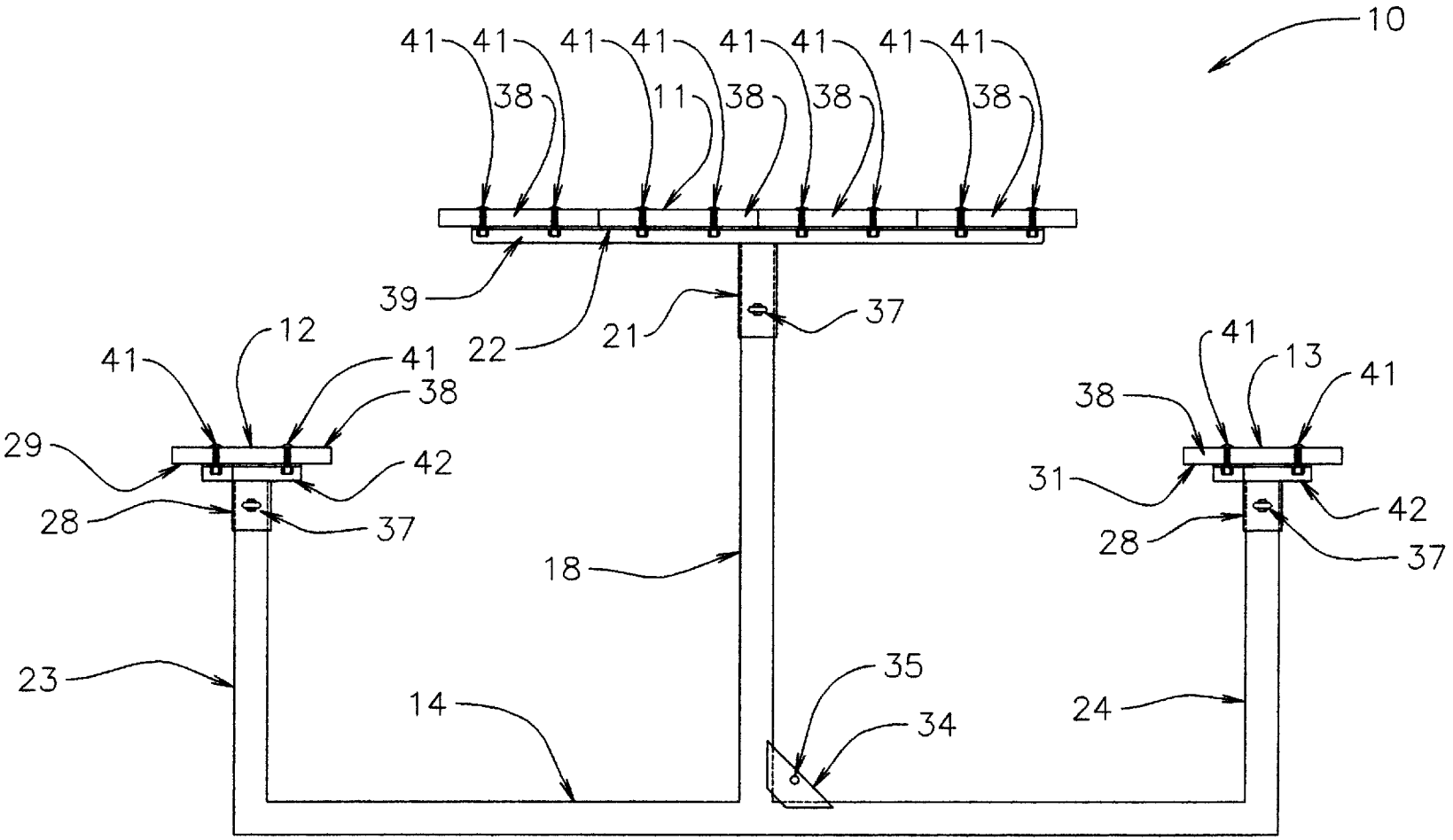
FIG. 2 is an end view of a picnic table made in accordance with the present invention in the set-up position.

Each support frame 14, 15 includes a middle leg 18 with an upper end 19 that is received within a bracket 21 attached to an underside 22 of the table top 11 as shown in FIG. 2. Each support frame 14, 15 also includes first and second opposing legs 23, 24 which include upper ends 25, 26 that are received within brackets 28 disposed along the undersides 29, 31 of the bench seats 12, 13 respectively. Further, each support frame 14, 15 also includes a lower support 32, 33 respectively which engages the ground and provides a steady support for the table when in the set-up or assembled position.

Figure 6:
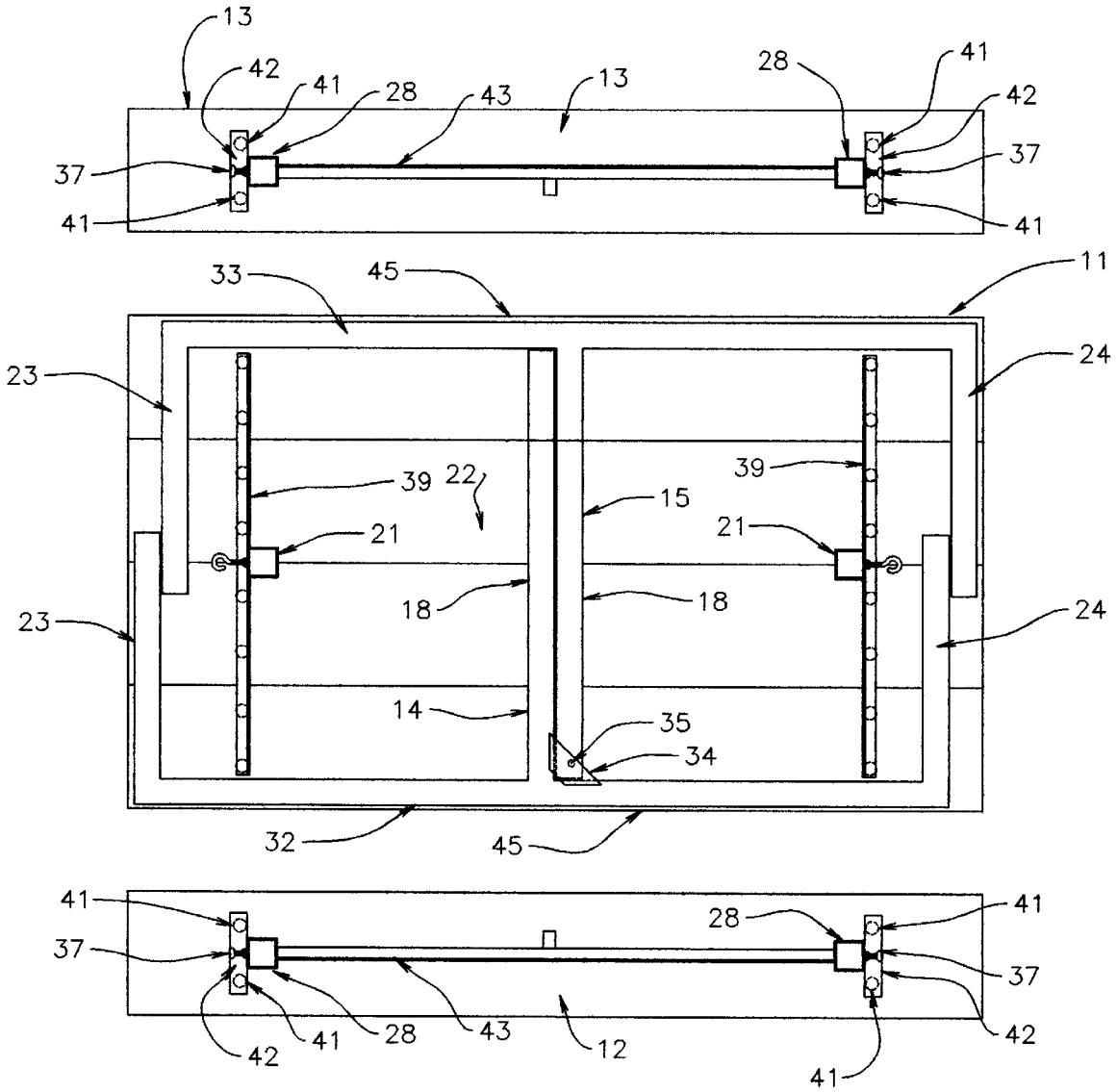
FIG. 6 is a bottom plan view of the picnic table shown in FIG. 1 with the support frames in the collapsed position.

Still referring to FIG. 2, the support frame 14 further includes a plate 34 with a pin 35 disposed therein. Referring back to FIG. 1, the upper end 19 of the middle leg 18 of the support frame 15 includes a hole 36. As illustrated in FIG. 6, the hole 36 of the support frame 15 is in matching registry with the pin 35 of the support frame 14 when the two support frames 14, 15 are disposed on the underside 22 of the table top 11 in the collapsed position as will be discussed below.

Referring back to FIG. 2, the brackets 21, 28 preferably include a threaded stud or pin 37 that can be used to frictionally engage the upper ends 25, 19, 26 of the legs 23, 18, 24 of the support frames 14, 15 when the table 10 is in the set-up or assembled position as shown in FIG. 2. It will also be noted from FIG. 2 that the table top 11 may be fabricated from a plurality of boards 38 and the bench seats 12, 13 may also be fabricated from like boards 38. In an embodiment, the boards 38 are one inch by eight inch pine boards. Pine is a suitable wood because it is sufficiently strong and lightweight. Of course, other lumber and other dimensions may be utilized.

Figure 3:
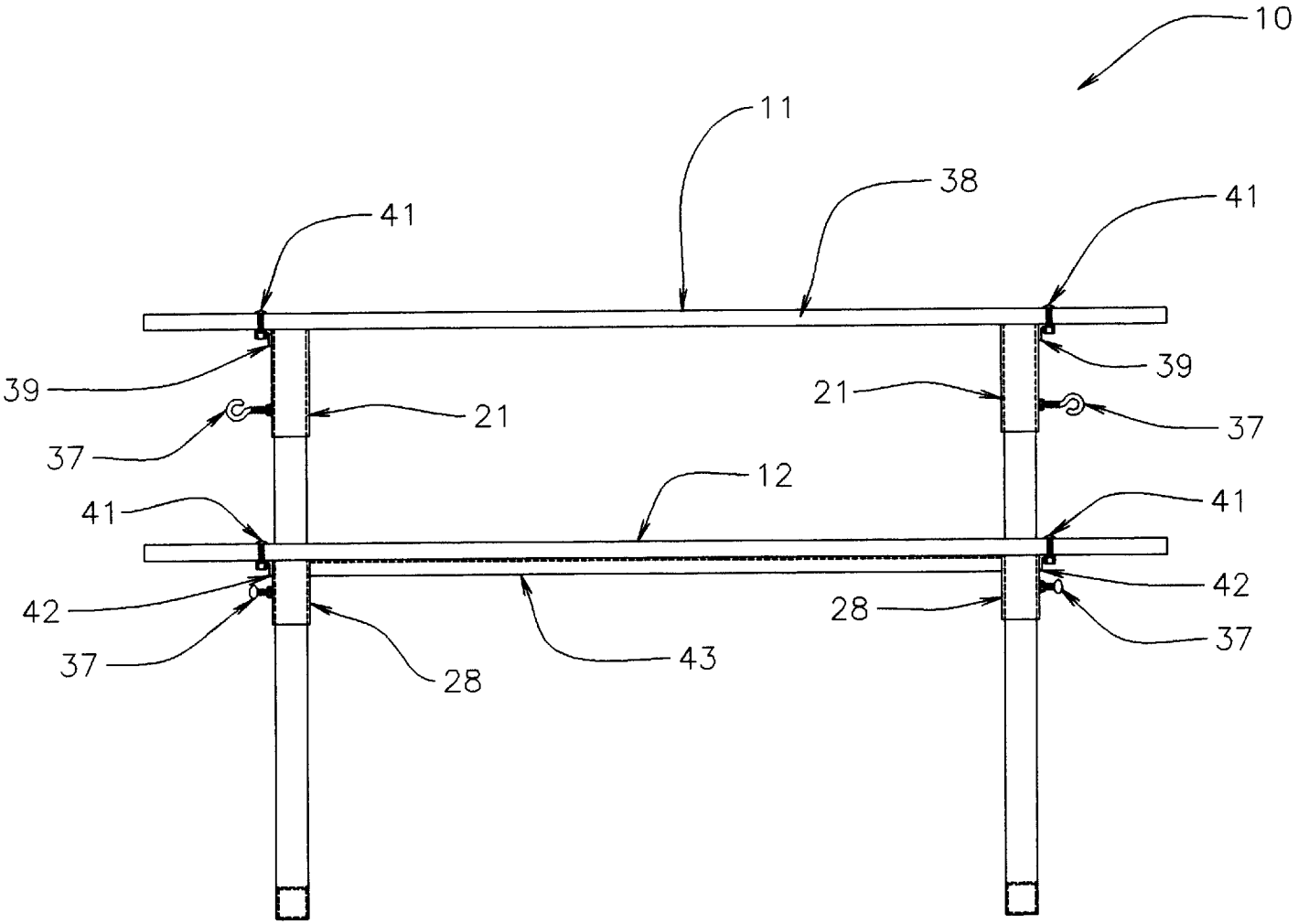
FIG. 3 is a front plan view of the picnic table shown in FIG. 1.
Figure 4:
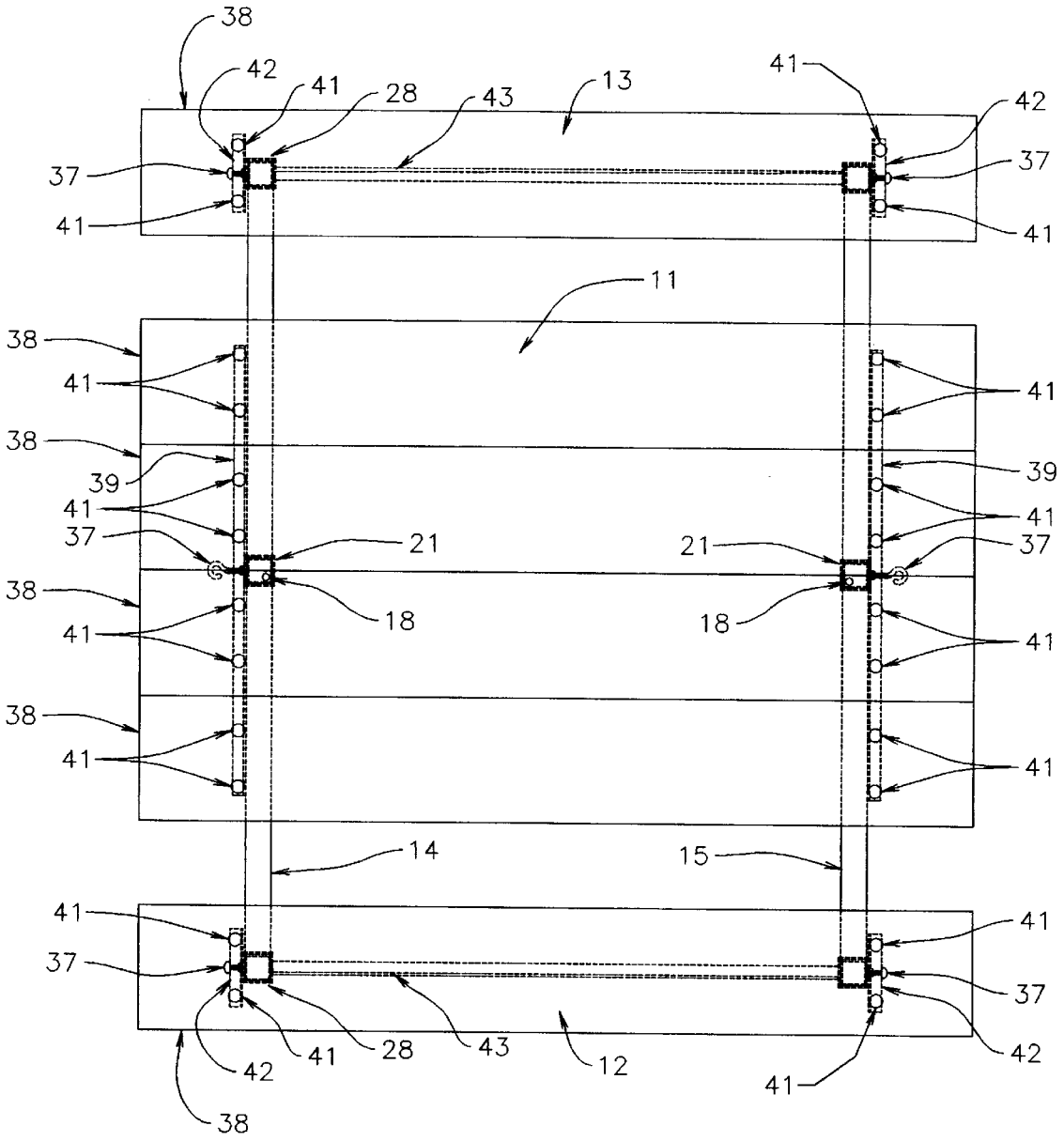
FIG. 4 is a top plan view of the picnic table shown in FIG. 1.

The boards 38 of the table top 11 are connected by way of a tie bar 39 and a plurality of bolts 41. Similarly, the boards 38 of the bench seats 12, 13 may be connected by way of a tie bar 42 and similar bolts 41. As shown in FIG. 3, the tie bars 39 of a table top 11 and the tie bar 42 of the bench seats 12, 13 each comprise a piece of angle iron. For structural support, an additional support 43 preferably connects the brackets 28 of the bench seats 12, 13.

As further illustrated in FIGS. 2 and 3, the brackets 28 and 37 matably receive the legs 23, 18, 24 of the support frames 14, 15. Of course, it will be understood that this configuration could be reversed so that the brackets 28 and 37 could be matably received within a hollow end of one of the legs 23, 18, 24 of the support frames 14, 15. Further, the sleeve-type brackets shown at 28, 37 could be replaced with a solid shaft extending downward from the undersides 29 and 31 of the bench seats 12, 13 and the underside 22 of the table top 11.

Figure 5:
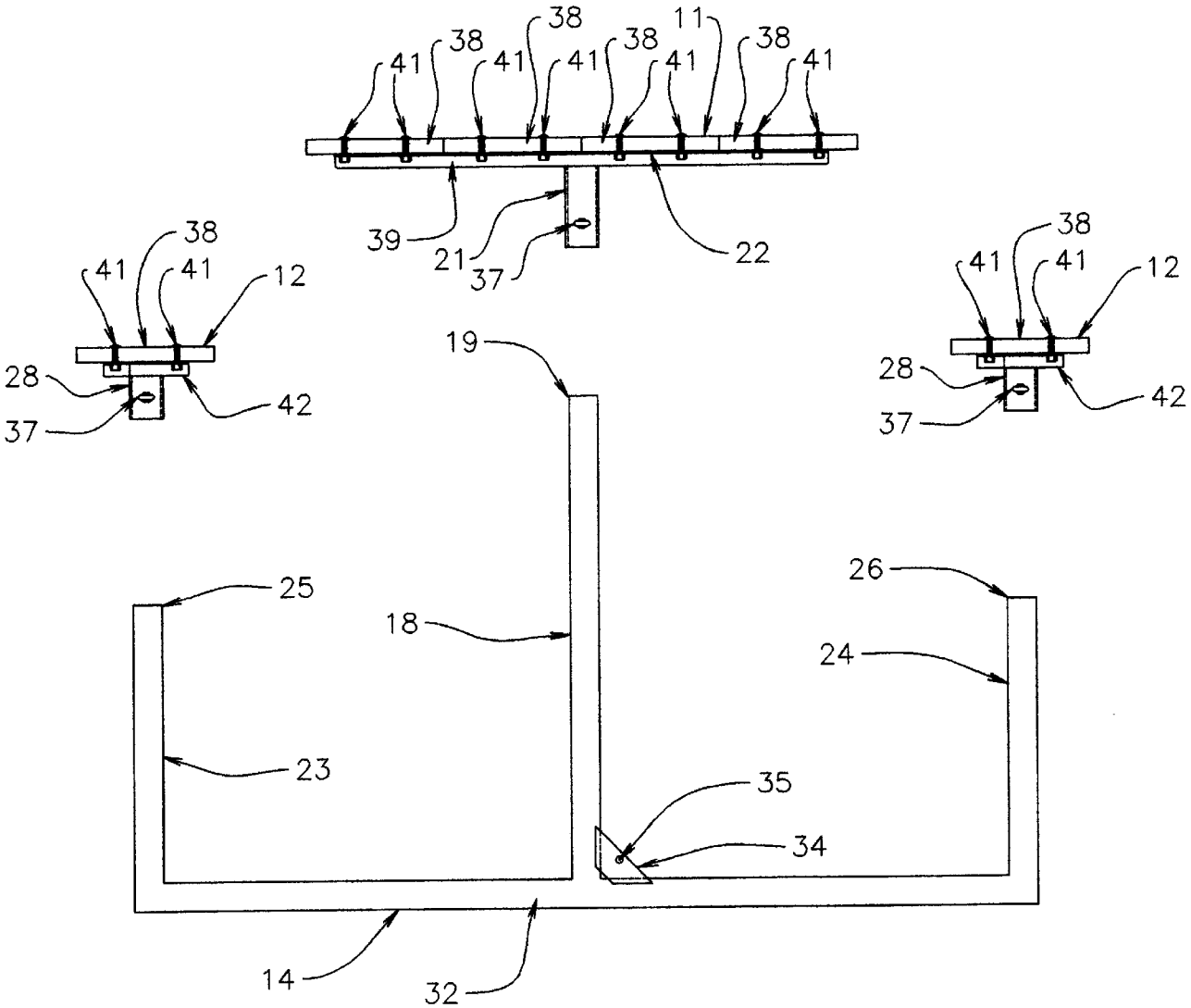
FIG. 5 is an exploded end view of the picnic table shown in FIG. 1.

As illustrated in FIG. 5, the table top 11 and bench seats 12, 13 easily lift off of the support frames 14, 15 after the fasteners 37 have been loosened.

As illustrated in FIG. 6, in order to assemble the table 10 into the collapsed position for transporting the table 10, the bench seats 12, 13 and the table top 11 are removed from the supports 14, 15. After the table top 11 is laid down onto the ground or other surface with the underside 22 disposed upward, the support frames 14, 15 are placed on top of the underside 22 of the table top 11 in the position as shown with the lower supports 32, 33 respectively disposed along the outer side 45, 46 of the table top 11 respectively. The middle legs 18 are disposed in a juxtaposed relationship with the middle leg 18 of the support frame 15 disposed underneath the plate 34 of the support frame 14. As noted above, the pin 35 of the plate 34 is disposed in matching registry with the hole 36 of the middle leg 18 of the support frame 15. Thus, a fastener, such as a screw or bolt may be used to connect the support frames 14, 15. After the support frames 14, 15 are laid down in place as shown in FIG. 6, the bench seats 12, 13 are placed on top of the support frames 14, 15 and on opposing sides of the brackets 21 disposed on the underside 22 of the table top 11. The alignment of the bench seats 12, 13 with respect to the brackets 21 is illustrated in FIGS. 7 and 8 as is the use of the tie-down brackets 16, 17.

Figure 7:
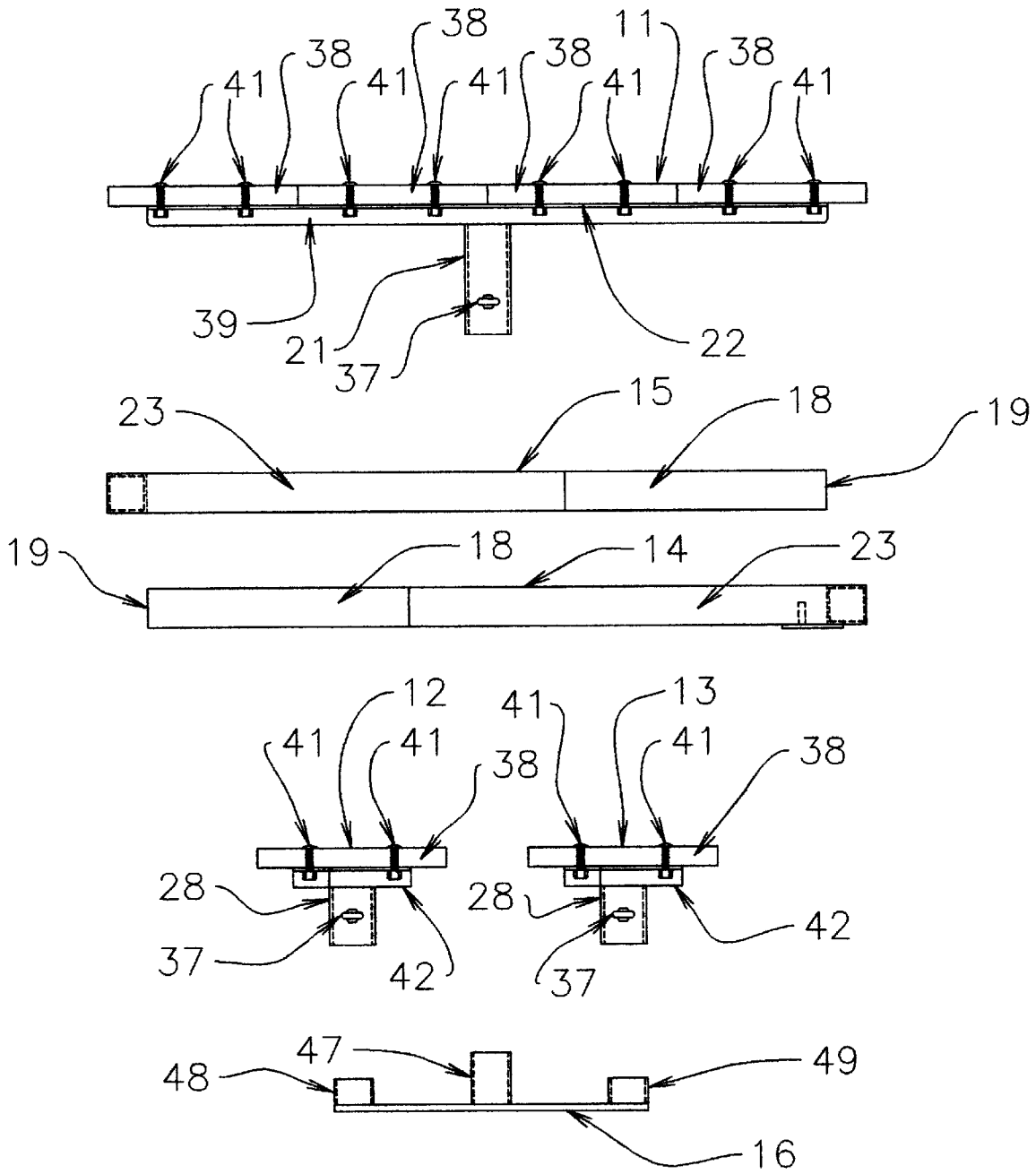
FIG. 7 is an exploded end view of the collapsed position of the picnic table first shown in FIG. 1.
Figure 8:
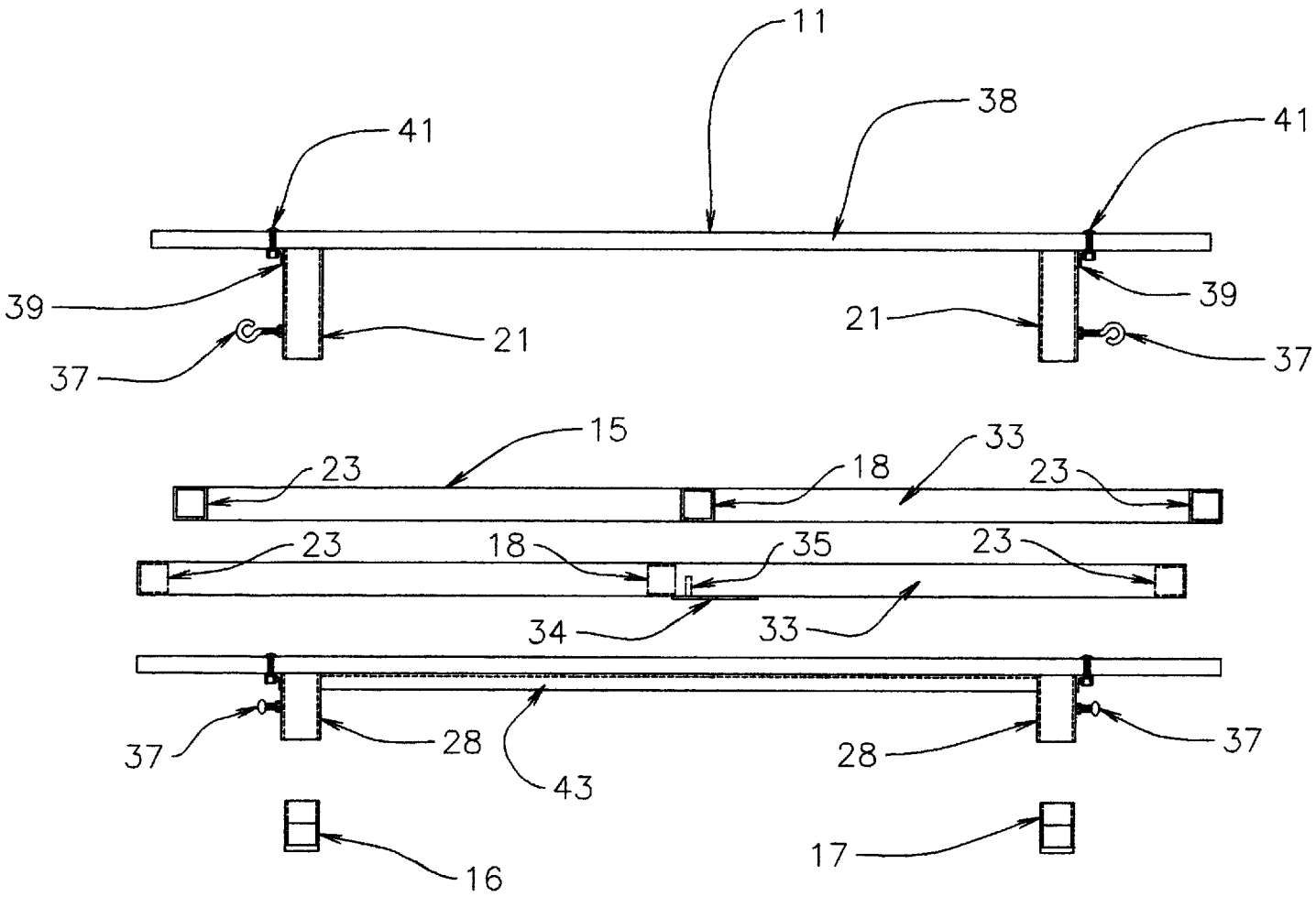
FIG. 8 is an exploded front view of the collapsed position of the picnic table first shown in FIG. 1.
Figure 9:
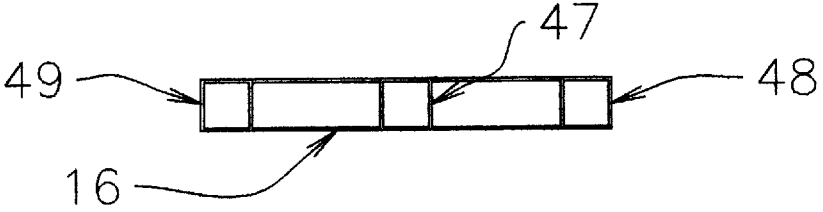
FIG. 9 is a plan view of a tie-down bracket for securing the picnic table first shown in FIG. 1 in the collapsed position.
Figure 10:
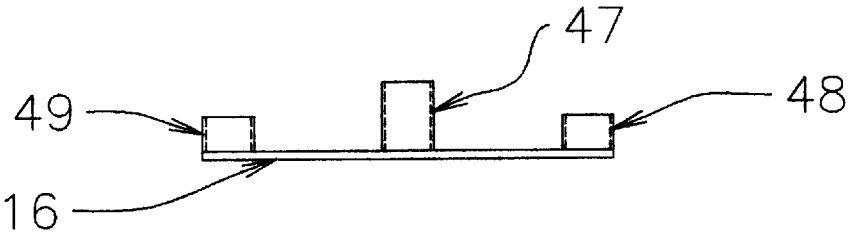
FIG. 10 is a bottom plan view of the tie-down bracket shown in FIG. 9.

Referring now to FIG. 7, it can be seen that when the bench seats 12, 13 are laid on top of the support frames 14, 15 and on opposing sides of the brackets 21 attached to the underside 22 of the table top 11, the brackets 28 of the bench seats 12, 13 may be attached to the brackets 21 of the table top 11 with the tie-down bracket 16. Specifically, the tie-down bracket 16 includes a middle leg 47 which is disposed between outer legs 48, 49. The outer legs 48, 49 are accommodated within the brackets 28 of she bench sleeves 12, 13 and the middle leg 47 is accommodated within the bracket 21 of the table top 11. When the connection between the bench seats 12, 13 and the table top 11 is made with the tie-down brackets 16, 17 (not shown in FIG. 7—see FIG. 8), the bench seats 12, 13 are securely attached to the underside 22 of the table top 11 and, further, the support frames 14, 15 are securely trapped between the bench seats 12, 13 and the table top 11. Hence, in this collapsed position, which is shown in the exploded view of FIG. 7, the table top is readily transported and is further sufficiently compact to fit within the cargo area of a small or mini-van or the trunk of a larger sedan.

Accordingly, a collapsible and transportable table 10 is provided which, when purchased by the consumer, includes only seven separate parts: the table top 11, the bench seats 12, 13, the support frames 14, 15 and the tie-down brackets 16, 17. The pins shown at 37 are attached to the respective brackets 21 or 28 and therefore will not become lost through use. Further, it is unlikely that the tie-down brackets 16, 17 will become lost during use due to their relative large size.

In a preferred embodiment, the support frames 14, 15 are fabricated from a 1½ inch by 1½ inch 14 gauge square tube material while the brackets 21 attach to the underside 22 of the table top are fabricated from 1¾ inch by 1¾ inch by 5 inch by 13 gauge square tube, while the brackets 28 attach to the undersides of the bench seats 12, 13 are fabricated from 1¾ inch by 1¾ inch by 3 inch by 13 gauge square tube. As noted above, the boards 38 are preferably 1 inch by 8 inch S4S #2 pine boards but may be fabricated from another suitable lumber.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A collapsible and portable table comprising:

a table top, a first bench seat, a second bench seat, a first support frame for detachably connecting the table top to the first and second bench seats and a second support frame for detachably connecting the table top to the first and second bench seats, each support frame comprising a middle leg comprising an upper end for engaging the table top, a first opposing leg comprising an upper end for engaging the first bench seat and a second opposing leg comprising an upper end for engaging the second bench seat, the table top comprising a first bracket for detachably connecting the table top to the upper end of the middle leg of the first support frame and a second bracket for detachably connecting the table top to the upper end of the middle leg of the second support frame, the first bench seat comprising a pair of spaced-apart brackets, one of said spaced-apart brackets for detachably connecting the first bench seat to the upper end of the first leg of the first support frame, the other of said spaced-apart brackets for detachably connecting the first bench seat to the upper end of the first leg of the second support frame, each of said spaced-apart brackets of the first bench seat comprise a downwardly extending sleeve for receiving the upper end of one of the first legs of the first and second support frames respectively, each of said downwardly extending sleeves of each of said spaced-apart brackets of the first bench seat comprise a hole for accommodating a pin that is threadably connected to the sleeve, the pin passing through the hole in the downwardly extending sleeve and engaging the leg which has been received in said bracket, the second bench seat comprising a pair of spaced-apart brackets, one of said spaced-apart brackets for detachably connecting the second bench seat to the upper end of the second leg of the first support frame, the other of said spaced-apart brackets for detachably connecting the second bench seat to the upper end of the second leg of the second support frame.

2. The table of claim 1 wherein the first bracket of the table top comprises a downwardly extending sleeve for receiving the upper end of the middle leg of the first support frame, the second bracket of the table top comprises a downwardly extending sleeve for receiving the upper end of the middle leg of the second support frame.

3. The table of claim 2 wherein the downwardly extending sleeve of the first bracket of the table top further comprises a hole, the table further comprises a first pin that is threadably connected to the hole of the first bracket and that may be extended through the hole of the first bracket to engage the upper end of the middle leg of the first support frame after the upper end of the middle leg of the second support frame is received in the first bracket, and wherein the downwardly extending sleeve of the second bracket of the table top further comprises a hole, the table further comprises a second pin that is threadably connected to the hole of the second bracket and that may be extended through the hole of the second bracket to engage the upper end of the middle leg of the second support frame after the middle leg of the second support frame is received in the second bracket.

4. The table of claim 1 wherein each of said spaced-apart brackets of the second bench seat comprise a downwardly extending sleeve for receiving one of the second legs of the first and second support frames respectively.

5. The table of claim 4 wherein each of said downwardly extending sleeves of each of said spaced-apart brackets of the second bench seat comprise a hole for accommodating a pin that is threadably connected to the sleeve, the pin passing through the hole in the downwardly extending sleeve and engaging the leg which has been received in said bracket.

6. The table of claim 1 further comprising two E-shaped tie-down brackets, each tie-down bracket comprising a middle leg disposed between first and second opposing legs, with the first and second bench seats disposed underneath the table top with the first and second brackets of the table top disposed between the first and second bench seats and with the first and second support frames being disposed between the bench seats and the table top, each of said first legs of the first and second tie-down brackets being connected to one of the brackets of the first bench seat, each of said second legs of the first and second tie-down brackets being connected to one of the brackets of the second bench seat and each of said middle legs of the first and second tie-down brackets being connected to one of the first and second brackets of the table top thereby securing the first and second support frames and first and second bench seats underneath the table top in a collapsed position.

7. The table of claim 6 wherein the support frames are connected together in said collapsed position.

8. The table of claim 1 wherein each of said first and second support frames is E-shaped wherein each of said first and second support frames further comprises a lower support that connects lower distal ends of the middle, first and second legs, the lower support of the first support frame having a length, the lower support of the second support frame having a length, the table top having a length, the lengths of the first and second support frames being less than the length of the table top.

9. A collapsible table comprising:

a table top comprising an underside having two opposing ends and a first bracket disposed adjacent to one end and a second bracket disposed adjacent to the other end, a first bench seat comprising an underside having two opposing ends and a first bracket disposed adjacent to one end and a second bracket disposed adjacent to the other end, a second bench seat comprising an underside having two opposing ends and a first bracket disposed adjacent to one end and a second bracket disposed adjacent to the other end, a first support frame for detachably connecting the first bracket of the table top to the first bracket of the first bench seat and to the first bracket of the second bench seat when the table is in an assembled position and a second support frame for detachably connecting the second bracket of the table top to the second bracket of the first bench seat and to the second bracket of the second bench seat when the table is in the assembled position, a first tie-down bracket for detachably connecting the first bracket of the table top to the first bracket of the first bench east and to the first bracket of the second bench seat when the table is in a collapsed position with the bench seats disposed underneath the table top and with the support frames disposed between the bench seats and an underside of the table top, and a second tie-down bracket for detachably connecting the second bracket of the table top to the second bracket of the first bench seat and to the second bracket of the second bench seat when the table is in the collapsed position.

10. The table of claim 9 wherein each of said first and second support frames is E-shaped wherein each of said first and second support frames further comprises a lower support that connects lower distal ends of the middle, first and second legs, the lower support of the first support frame having a length, the lower support of the second support frame having a length, the table top having a length, the lengths of the first and second support frames being less than the length of the table top.

11. The table of claim 10 wherein the support frames are connected together in said collapsed position.

12. The table of claim 9 wherein each support frame comprises a middle leg comprising an upper end for engaging one of the brackets of the table top, a first opposing leg comprises an upper end for engaging one of the brackets of the first bench seat and a second opposing leg comprises an upper end for engaging one of the brackets of the second bench seat.

13. The table of claim 12 wherein the first bracket of the table top comprises a downwardly extending sleeve for receiving the upper end of the middle leg of the first support frame, the second bracket of the table top comprises a downwardly extending sleeve for receiving the upper end of the middle leg of the second support frame.

14. The table of claim 13 wherein the downwardly extending sleeve of the first bracket of the table top further comprises a hole, the upper end of the middle leg of the first support frame comprises a hole that is in matching registry with the hole of the first bracket when the upper end of the middle leg of the second support frame is received in the first bracket, the table further comprises a first pin that is threadably connected to the hole of the first bracket and that may be extended through the hole of the upper end of the middle leg of the first support frame when the upper end of the middle leg of the second support frame is received in the first bracket to secure the connection between the first bracket and the middle leg of the first support frame, and wherein the downwardly extending sleeve of the second bracket of the table top further comprises a hole, the upper end of the middle leg of the second support frame comprises a hole that is in matching registry with the hole of the second bracket when the upper end of the middle leg of the second support frame is received in the second bracket, the table further comprises a second pin that is threadably connected to the hole of the second bracket and that may be extended through the hole of the upper end of the middle leg of the second support frame when the middle leg of the second support frame is received in the second bracket to secure the connection between the second bracket and the middle leg of the second support frame.

15. The table of claim 11 wherein each of said tie-down brackets is further characterized as being E-shaped and comprises a middle leg disposed between first and second opposing legs, with the first and second bench seats disposed underneath the table top with the first and second brackets of the table top disposed between the first and second bench seats and with the first and second support frames being disposed between the bench seats and the table top, each of said first legs of the first and second tie-down brackets being connected to one of the brackets of the first bench seat, each of said second legs of the first and second tie-down brackets being connected to one of the brackets of the second bench seat and each of said middle legs of the first and second tie-down brackets being connected to one of the first and second brackets of the table top thereby securing the first and second support frames and first and second bench seats underneath the table top in a collapsed position.

16. The table of claim 9 wherein the first and second brackets of the first bench seat comprise a downwardly extending sleeve for receiving an upper end of one of the first legs of the first and second support frames respectively, and wherein each of said downwardly extending sleeves of each of said first and second brackets of the first bench seat comprise a hole for accommodating a pin that is threadably connected to the sleeve, each of the upper ends of the first legs of the first and second support frames further comprises a hole that is in matching registry with the hole of one of the first and second brackets of the first bench seat when the upper ends of the first legs are received within one of said first and second brackets of the first bench seat, the holes of the upper ends of the first legs receiving the pin passing through the hole in the downwardly extending sleeve in which the leg has been received, and wherein each of said first and second brackets of the second bench seat comprise a downwardly extending sleeve for receiving one of the second legs of the first and second support frames respectively, and wherein each of said downwardly extending sleeves of each of said first and second brackets of the second bench seat comprise a hole for accommodating a pin that is threadably connected to the sleeve, each of the upper ends of the second legs of the first and second support frames further comprises a hole that is in matching registry with the hole of one of the first and second brackets of the second bench seat when the upper ends of the second legs are received within one of said first and second brackets of the second bench seat, the holes of the upper ends of the second legs receiving the pin passing through the hole in the downwardly extending sleeve in which the leg has been received.

17. A collapsible table comprising:

a table top comprising a first bracket and a second bracket, a first bench seat comprising a first bracket and a second bracket, a second bench seat comprising a first bracket and a second bracket, a first support frame for detachably connecting the first bracket of the table top to the first bracket of the first bench seat and to the first bracket of the second bench seat when the table is in an assembled position and a second support frame for detachably connecting the second bracket of the table top to the second bracket of the first bench seat and to the second bracket of the second bench seat when the table is in the assembled position, a first tie-down bracket for detachably connecting the first bracket of the table top to the first bracket of the first bench seat and to the first bracket of the second bench seat when the table is in a collapsed position with the bench seats disposed underneath the table top and with the support frames disposed between the bench seats and an underside of the table top, and a second tie-down bracket for detachably connecting the second bracket of the table top to the second bracket of the first bench seat and to the second bracket of the second bench seat when the table is in the collapsed position.

* * * * *